US007503120B2

(12) United States Patent
Williams

(10) Patent No.: US 7,503,120 B2
(45) Date of Patent: Mar. 17, 2009

(54) CUTTER ADAPTED TO BE HELD BY HUMAN HAND OR FINGER

(75) Inventor: Irene E. Williams, Lakewood, OH (US)

(73) Assignee: Henkel Corporation, Gulph Mills, PA (US)

( * ) Notice: Subject to any disclaimer, the term of this patent is extended or adjusted under 35 U.S.C. 154(b) by 103 days.

(21) Appl. No.: 11/178,676

(22) Filed: Jul. 11, 2005

(65) Prior Publication Data

US 2007/0006469 A1 Jan. 11, 2007

(51) Int. Cl.
*B26F 1/00* (2006.01)
*B26F 1/14* (2006.01)
*B26F 1/24* (2006.01)

(52) U.S. Cl. ..... 30/165; 30/366; 30/368; 83/866; 83/588; 83/684; 401/7

(58) Field of Classification Search ..... 30/165, 30/444, 366, 448, 442, 367, 368; 83/366, 83/588, 660, 684, 866, 868; 220/278, 277, 220/260, 261, 262
See application file for complete search history.

(56) References Cited

U.S. PATENT DOCUMENTS

| | | | | | |
|---|---|---|---|---|---|
| 931,511 | A | | 8/1909 | Southworth | |
| 1,134,043 | A | | 3/1915 | Gierhart | |
| 1,324,672 | A | | 12/1919 | Hempel | |
| 1,689,047 | A | * | 10/1928 | Packer | 30/366 |
| 2,338,592 | A | * | 1/1944 | Lorenzen | 30/443 |
| 2,417,638 | A | * | 3/1947 | Egowin | 30/366 |
| 2,418,984 | A | * | 4/1947 | Payne | 30/368 |
| 2,676,400 | A | | 4/1954 | Darpinian | |
| 2,708,972 | A | * | 5/1955 | Park | 30/367 |
| 2,878,845 | A | * | 3/1959 | Hale | 52/749.1 |
| 2,888,745 | A | | 6/1959 | Beck | |
| 2,989,807 | A | | 6/1961 | Florence | |
| 3,349,821 | A | * | 10/1967 | Moeller | 99/646 R |
| 3,559,445 | A | * | 2/1971 | Hougen | 72/325 |
| 3,587,591 | A | | 6/1971 | Satterwhite | |
| 3,644,993 | A | | 2/1972 | Chupp | |
| 3,947,132 | A | * | 3/1976 | Fox | 401/7 |
| 4,339,878 | A | | 7/1982 | Tozzi | |
| 4,469,249 | A | * | 9/1984 | Malpas et al. | 222/83 |
| 4,649,733 | A | * | 3/1987 | Gilmore | 72/479 |
| 4,986,682 | A | * | 1/1991 | Lu | 401/7 |
| 5,323,538 | A | * | 6/1994 | Sutterlin | 30/366 |

(Continued)

*Primary Examiner*—Ghassem Alie
(74) *Attorney, Agent, or Firm*—Fay Sharpe LLP

(57) ABSTRACT

The present invention involves a hand-held cutter device that is adapted to be held by a human hand, over a human finger, or between the human fingers. The cutter device includes a generally cylindrical inner sleeve slideably engaged with a generally cylindrical outer sleeve, where each sleeve includes an open end and a closed end. The inner sleeve has an extended position and a retracted position. A blade for cutting various materials is attached to the closed of the inner sleeve. A biasing element is confined between the sleeves and urges the inner sleeve into the retracted position. The closed end of the outer sleeve may include a plurality of flat guide surfaces, at least one straight guide groove, and or at least one guide rib. At least two of the plurality of flat guide surfaces may intersect at about a 90 degree angle and the at least one straight guide groove may be located within any of the plurality of flat guide surfaces.

12 Claims, 3 Drawing Sheets

U.S. PATENT DOCUMENTS

| | | | | |
|---|---|---|---|---|
| 5,758,423 | A | 6/1998 | Eversole et al. | |
| 5,791,056 | A * | 8/1998 | Messina | 30/361 |
| 5,829,299 | A * | 11/1998 | Wessels | 72/327 |
| 6,394,518 | B1 * | 5/2002 | Kelley | 294/61 |
| 6,557,730 | B1 * | 5/2003 | Kaye | 222/80 |
| 6,629,483 | B2 * | 10/2003 | Iwao | 83/866 |
| 2006/0117577 | A1 * | 6/2006 | King | 30/368 |
| 2006/0236552 | A1 * | 10/2006 | Giles | 30/366 |

* cited by examiner

CUTTER ADAPTED TO BE HELD BY HUMAN HAND OR FINGER

BACKGROUND

The present invention relates to cutting devices for cutting various types of material such as thin vinyl, plastic, paper, cardboard, or string. In particular, the present invention is directed to the art of hand-held cutting devices and cutting devices capable of being supported by at least one human finger.

Generally, finger mounted cutting devices exist in the art. However, these devices have a number of limitations. One limitation involves the breadth of material that prior art cutters can cut. In most cases, the prior art cutters are capable of cutting only a limited range of materials (e.g. grape stems or envelopes). Another limitation involves the ergonomic and safety aspects of the prior art cutters. Many prior art devices use an exposed fixed blade design which can lead to severe cuts if the user is not extremely careful at all times. In addition, other prior art devices attach to the user's hand in a manner that may result in fatigue and discomfort after extended use. Further limitations of the prior art cutters involve their ability to make straight, smooth, and consistent cuts.

For the reasons discussed above, it is the objective of the present invention to provide certain improvements in the art of hand-held cutting devices.

SUMMARY OF THE INVENTION

The present invention sets forth multiple novel improvements to the art of cutting devices that slide over or are supported by a human finger. These improvements primarily involve the safety, convenience, accuracy, and speed with which various types of material may be cut. The cutter invention described herein is a device that is comfortable to hold, simple to use, and capable of making quick and accurate cuts.

In one embodiment, the cutter device invention includes a generally cylindrical inner sleeve slideably engaged with a generally cylindrical outer sleeve, where each sleeve includes an open end and a closed end. The open end of the inner sleeve is adapted to fit over a human finger. The inner sleeve has an extended position and a retracted position with respect to the outer sleeve. A blade for cutting various materials is attached to the closed end of the inner sleeve. When the inner sleeve is in the extended position, the blade protrudes through a slot in the closed end of the outer sleeve thus permitting the user to bring the blade into contact with the material to be cut. A button is formed from the inner sleeve material resembling a tab and is bent slightly in an outward radial direction. A button aperture is disposed along the outer sleeve such that when the inner sleeve is in the extended position, the button is aligned with and engages the button aperture. A biasing element is confined between the sleeves and is disposed about the blade. When the button is pushed inward it disengages from the button aperture and the biasing element urges the inner sleeve into the retracted position. The inner sleeve further includes a pair of retaining ribs which project radially outward and engage a pair of retaining rib apertures in the outer sleeve. The retaining ribs prevent the inner sleeve from becoming disengaged with the outer sleeve. Lastly, the closed end of the outer sleeve includes a plurality of flat guide surfaces and a straight guide groove. A pair of the flat guide surfaces intersect at about a 90° angle to permit the cutter device to accurately cut material along an inside corner of an object. A large flat guide surface serves to maintain the blade at a fixed angle with the material to be cut permitting the user to make smooth straight cuts. Finally, the straight guide groove permits the user of the cutter device to make straight and accurate cuts along the edge of a support surface by gliding the straight guide groove along the edge of the support surface.

In another embodiment, one of the flat guide surfaces includes a guide rib which projects perpendicularly outward from a flat guide surface and extends linearly outward from the slot on the closed end of the outer sleeve. The guide rib provides a guide surface for guiding the cutter device along edges where a straight guide groove would not be as effective. For example, a sharp support edge is ideal for use with the straight guide groove whereas a corner with a large bend radius is not. The guide rib is particularly suited for such circumstances.

In yet another embodiment, a pair of straight guide grooves are disposed in an offset fashion on either side of the slot. The straight guide grooves extend linearly outward along one of the flat guide surfaces. Each straight guide groove operates in a similar fashion as discussed previously, however, the offset of the present embodiment permits the cutter device to cut the material just to the left or right of the edge of the support surface.

The following figures and description explain in greater detail the principles by which the novel improvements enhance the operation of the cutter device invention.

DETAILED DESCRIPTION

Figure 1C:
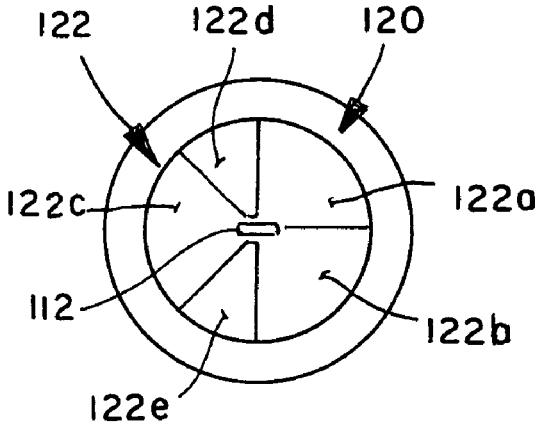
FIG. 1C is a top view of the first embodiment of the cutter device illustrating the plurality of guide surfaces on the closed end of the outer sleeve.
Figure 1A:
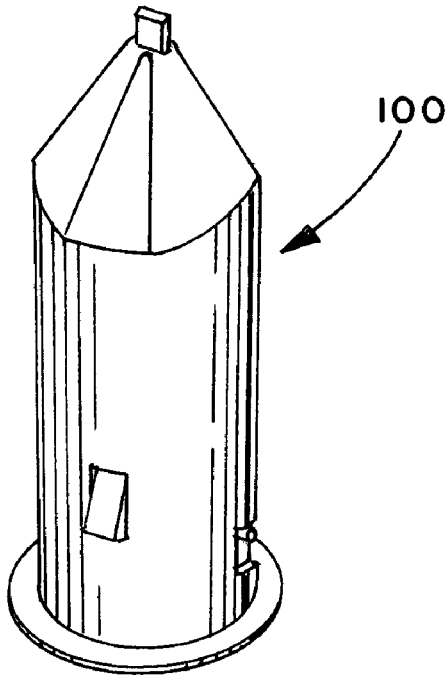
FIG. 1A is a perspective view of a first embodiment of the cutter device according to the present invention.
Figure 1B:
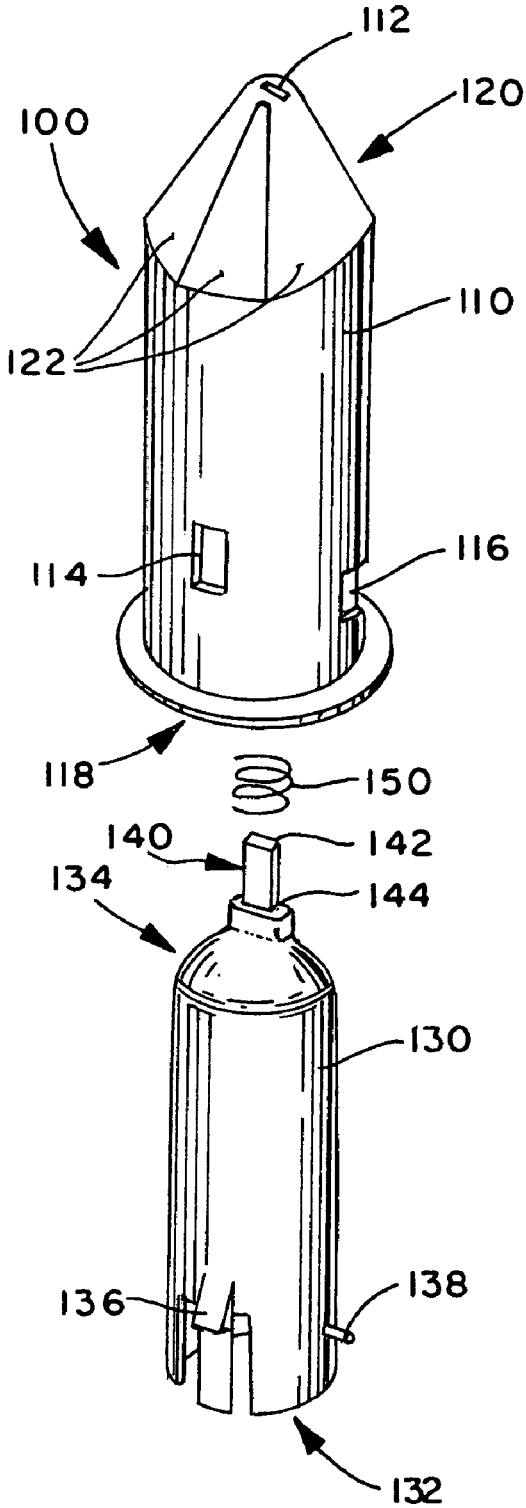
FIG. 1B is an exploded view of the first embodiment of the cutter device.

With reference to FIGS. 1A-1C, a first embodiment 100 of a cutter device is shown. In particular, FIG. 1A illustrates a perspective view of the cutter device 100 in its assembled configuration. Generally, the cutter device 100 comprises an outer sleeve 110, an inner sleeve 130, a blade 140 and a biasing element 150. The outer sleeve 110 includes a slot 112, a button aperture 114, at least one retaining rib aperture 116, an open end 118 and a closed end 120. The closed end 120 further comprises a plurality of flat guide surfaces 122.

The inner sleeve 130 generally includes an open end 132, a closed end 134, a button 136 and at least one retaining rib 138. The blade 140 is disposed on the closed end 134 of the inner sleeve 130. The blade 140 includes a sharp end 142 and a shank end 144. The sharp end 142 is intended to serve as the cutting edge for the cutter device 100. The shank end 144 provides a surface by which to attach the blade 140 to the inner sleeve 130. The button 136 of the inner sleeve 130 can be formed out of the same material of the inner sleeve by cutting a portion of the inner sleeve such as to form a tab. The button 136 is bent slightly outward such that when the inner sleeve 130 is inserted into the outer sleeve 110, the button 136 will elastically deflect inward and exert pressure between the button surface and the inner wall surface of the outer sleeve 110.

Prior to being assembled, the biasing element 150 (e.g. a compression spring), is placed over the blade 140 before the inner sleeve 130 is inserted into the outer sleeve 110. Once the inner sleeve 130 is inserted into the outer sleeve 110, a retaining rib 138 is punched outwardly through the retaining rib aperture 116. The retaining rib 138 may be punched out of the inner sleeve material itself or a pin may be inserted through the retaining rib aperture 116 once the inner sleeve 130 has been inserted into the outer sleeve 110. The inner sleeve 130 is sized appropriately such that it is slidably engageable with the outer sleeve 110. In addition, the open end 132 of the inner sleeve 130 is sized such that it will easily fit over an average sized human index finger. Once the cutter device 100 is fully assembled, the inner sleeve has two positions, an extended position and a retracted position. When the inner sleeve 130 is in the extended position, the blade 140 protrudes through the slot 112 in the outer sleeve 110 (as shown in FIG. 1A). Simultaneously, the button 136 will become aligned with the button aperture 114 in the outer sleeve 110. When the button 136 is aligned with the button aperture 114, the button will move in an outward direction extending partially into the button aperture 114 of the outer sleeve 110. When the button 136 is engaged in the button aperture 114, the inner sleeve 130 is held in the extended position. This aids the user of the cutter device 100 in that the user need not apply continuous pressure to the inner sleeve 130 to keep the blade 140 in an extended position while cutting. In order to release the inner sleeve 130, the user must depress button 136 such that it extends inward past the inner wall surface of the outer sleeve 110. When the button 136 has cleared the outer sleeve 110, the biasing element 150 urges the inner sleeve 130 towards the retracted position.

Now with reference to FIG. 1C, a top view of the closed end 120 of the outer sleeve 110 is shown. FIG. 1C particularly illustrates the plurality of flat guide surfaces 122. In the first embodiment 100, five flat guide surfaces are shown and are referenced individually using reference numerals 122*a*-122*d*. The flat guide surfaces 122 aid the user in cutting material while using the cutter device 100. For instance, the cutter 100 may be angled such that a large flat guide surface 122*c* contacts and is substantially parallel to the material being cut. In most cases the material to be cut is pliable (e.g. shelf liner material) and will require a support surface to support the material while being cut. It should be noted that in some cases the material to be cut is intended to conform to the specific dimensions of an object (e.g. the inside of a drawer) and the object itself serves as the support surface. In these cases, firm pressure is applied to the material and/or the support surface while keeping one of the flat guide surfaces 122 in sliding contact and parallel to the material and/or the support surface. Using one of the flat guide surfaces 122 to guide the cutter 100 aids the user in making smooth and aesthetically pleasing cuts.

In particular, the large flat guide surface 122*c* of the closed end 120 facilitates in keeping the blade 140 in perpendicular alignment with the material being cut. The consistent alignment of the blade 140 with respect to the material while cutting further ensures a uniform and smooth cut. The cutter device 100 may also be used to cut material that is present on an inside corner edge of a compartment, such as a drawer. The flat guide surfaces 122*a* and the flat guide surface 122*b* intersect at about a 90° angle. The intersection of the flat guide surfaces 122*a*, 122*b* at about the 90° angle facilitate the cutting of material along an inside corner. For example, when placing shelf liner material inside a drawer, the user would place the cutter device 100 with the 90° intersecting surfaces 122*a*, 122*b* in towards the inside corner edge of the drawer. The user would then glide the cutter device 100 along the inside corner edge cutting the shelf liner material accurately and smoothly in one pass.

It should be noted that the intersection angle need not be precisely 90 degrees. The intersection angle may vary by several degrees. Such minor variation will not adversely impact the operation of any embodiment of the cutter device discussed herein. Furthermore, although the first embodiment 100 and subsequent embodiments describe a cutter device with an inner sleeve adapted to fit over a human finger, all of these embodiments may be grasped or held between the fingers of a human hand. For instance, the embodiments described herein may be held like a pencil or a pen by gripping the cutter device between the thumb, index finger, and middle finger. Alternatively, the user may simply slide the cutter device over one available finger to free the remaining fingers for other tasks. Depending on the specific cutting application, the user may prefer supporting the cutter between the fingers or over a single finger.

Now with reference to FIGS. 2A-2E, a second embodiment of a cutter device 200 is shown. The structure of the second embodiment of the cutter device 200 is similar to that of the first embodiment of the cutter device 100. The second embodiment 200 departs from the first embodiment 100 in three primary ways. First, the closed end 220 of the outer sleeve 210 has a combination of flat guide surfaces 222 and curved surfaces which represent blending of the sharp edges where the surfaces 222 would intersect. Another difference in which the second embodiment 200 departs from the first embodiment 100 is a push button 236. In the second embodiment 200, the push button 236 includes a series of raised ribs. The series of raised ribs provide a larger gripping area by which the user may apply pressure in order to advance or retract an inner sleeve 230. The third difference between the second embodiment 200 and the former embodiment 100 is a straight guide groove 224 which initiates from a slot 212 and extends in a linear and outward fashion along the large flat guide surface 222*c*. The straight guide groove 224 allows a user of the cutter device 200 to place the closed end 220 along the edge of a support surface and to cut along that edge. In this manner, the straight guide groove 224 facilitates the user in cutting material in a straight and smooth fashion. As with the first embodiment 100, the second embodiment 200 includes a retaining rib aperture 216*a*, and a retaining rib 238*a*.

Figure 2A:
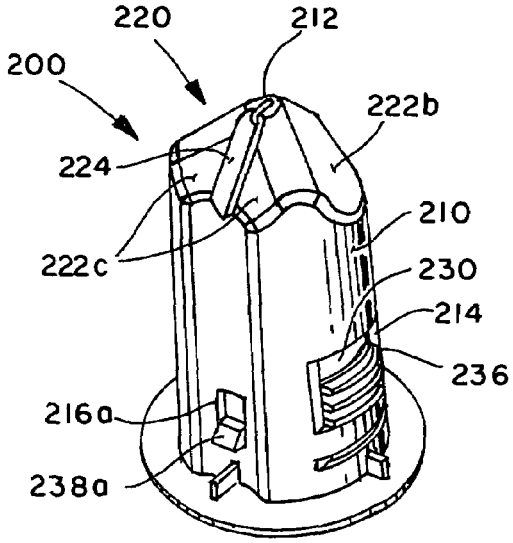
FIG. 2A is a perspective view of a second embodiment of the cutter device according the present invention illustrating a first side of the cutter.
Figure 2B:
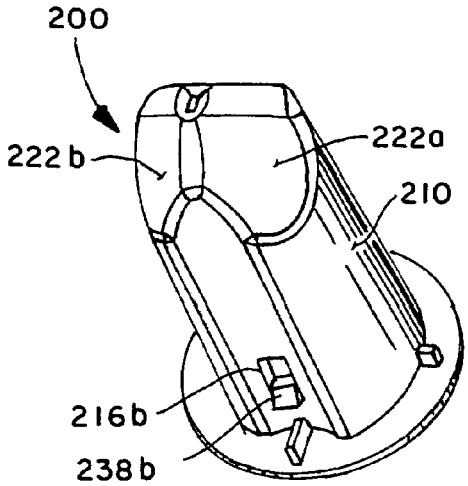
FIG. 2B is a perspective view of the second embodiment of the cutter device illustrating a second side of the cutter.

Now with reference to FIG. 2B, a second side of the second embodiment of the cutter device 200 is shown. As in the first embodiment 100, the second embodiment also includes a pair of flat guide surfaces 222*a* and 222*b* whose imaginary intersection (projected from the flat section of each guide surface 222*a* and 222*b*) would result in about a 90° angle. As discussed before, the approximate 90° separation between the flat guide surfaces 222*a*, 222*b* allows the user to cut along an inside corner edge using the cutter device 200. Also noted in FIG. 2B is an additional retaining rib 238*b* on the inner sleeve 230. To accommodate the additional rib 238*b*, the outer sleeve 210 has a retaining rib aperture 216*b*.

Figure 2C:
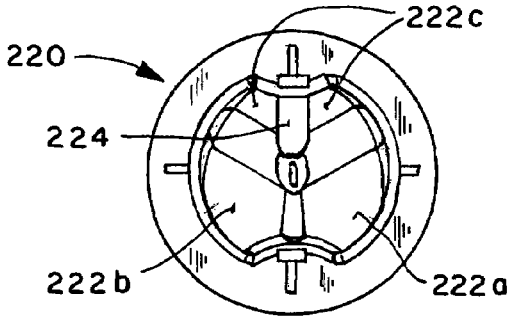
FIG. 2C is a top view of the second embodiment of the cutter illustrating a plurality of guide surfaces on a closed end of an outer sleeve.
Figure 2D:
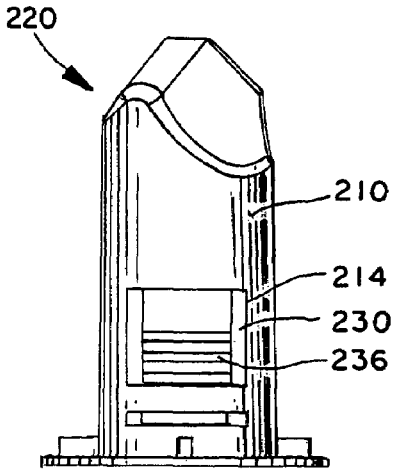
FIG. 2D is an elevation view of the second embodiment of the cutter device illustrating a button and a button aperture of an inner sleeve and the outer sleeve, respectively.
Figure 2E:
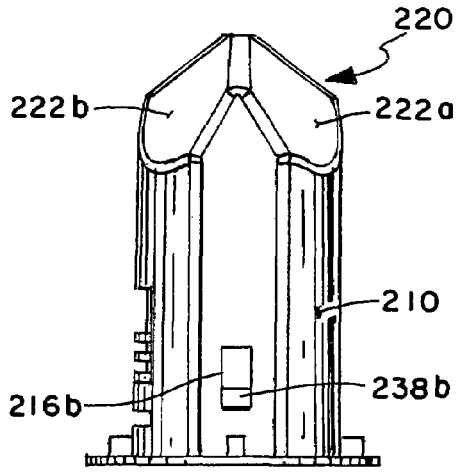
FIG. 2E is an elevation view of the second embodiment of the cutter device illustrating the first side of the cutter.

Now with reference to FIG. 2C, the top view of the cutter device of the second embodiment of the cutter device 200 is shown. FIG. 2C illustrates the orientation of the flat guide surfaces 222*a*, 222*b*, and 222*c* with respect to the straight guide groove 224. With reference to FIG. 2D, the outer sleeve 210 is shown in an orientation which illustrates the button 236, the inner sleeve 230, and the button aperture 214. FIG. 2E depicts a side elevation view of the second side of the cutter device 200, illustrating the outer sleeve 210, the additional retaining rib aperture 216*b*, the additional retaining rib 238*b*, and the 90° intersecting flat guide surfaces 222*a*, 222*b*.

Figure 3:
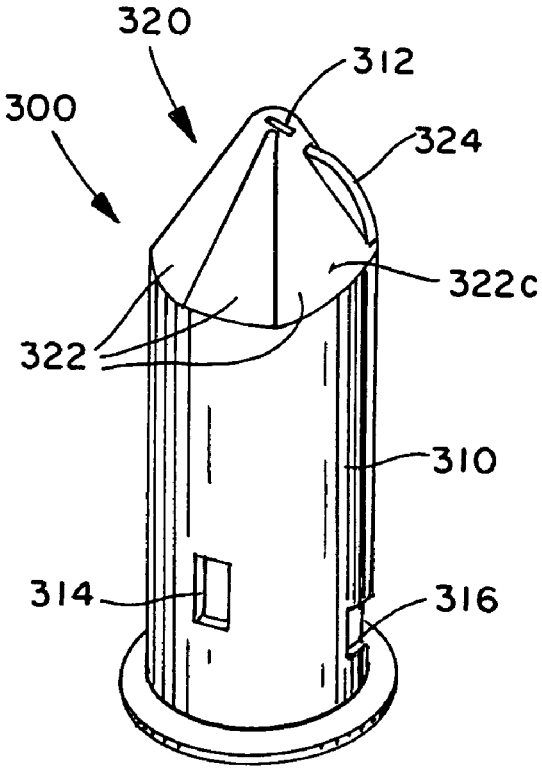
FIG. 3 is a perspective view of a third embodiment of the cutter device illustrating an outer sleeve with a guide rib on a closed end of an outer sleeve.

Now with reference to FIG. 3, a third embodiment is shown of a cutter device 300. As with the first and second embodiments 100, 200 the third embodiment 300 of the cutter device is similar in structure. As shown in FIG. 3, a closed end 320 of an outer sleeve 310 has a plurality of flat guide surfaces 322. A large flat guide surface 322*c* includes a guide rib 324. The guide rib 324 initiates at a location proximal to the slot opening and extends linearly along the large flat guide surface 322*c*. The guide rib 324 also projects perpendicularly outward from the large flat guide surface 322*c*. As in the case of the former embodiments (which use either the flat guide surfaces separated by about a 90° angle or the straight guide groove), the guide rib 324 also serves to guide the cutter along the edge of a support surface. The guide rib 324 provides a guide surface for guiding the cutter 300 along edges where a straight guide groove would not be as effective. For example, a sharp support edge is ideal for use with the straight guide groove whereas a corner with a large bend radius is not. The guide rib 324 is particularly suited for such circumstances. As with the first embodiment 100, the third embodiment 300 includes a button aperture 314, and a retaining rib aperture 316.

Figure 4:
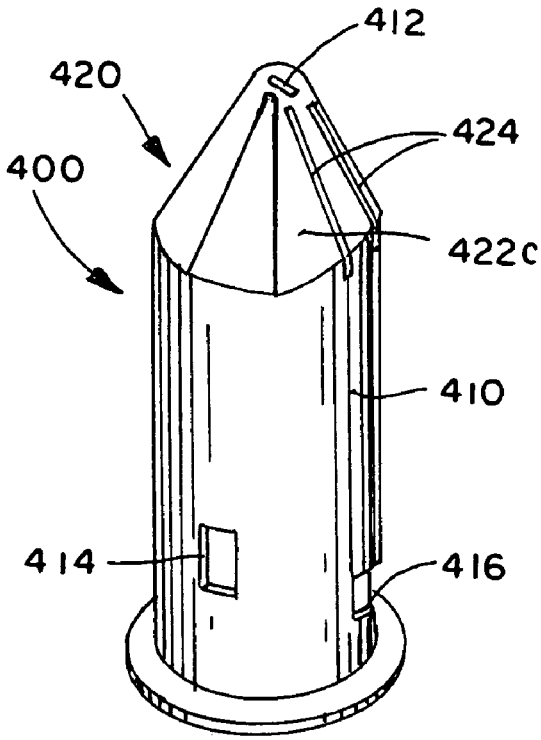
FIG. 4 is a perspective view of the third embodiment of the cutter device illustrating a plurality of straight guide grooves on a plurality of guide surfaces of the outer sleeve.

With reference to FIG. 4, a fourth embodiment of a cutter device 400 is shown. In this case, the cutter device 400 is shown having two straight guide grooves 424 along a large flat guide surface 422*c* of a closed end 420 of an outer sleeve 410. The straight guide grooves 424 begin at a location on either side of a blade slot 412 and extend in a linear fashion down the large flat guide surface 422*c*. As before, the straight guide grooves 424 provide another mechanism by which the closed end 420 of the outer sleeve 410 may be used to guide along the edge of a support surface. Since the fourth embodiment 400, includes an offset straight guide groove on either side of the blade slot 412, the user may cut the material so that the material is just short of or slightly over the support edge (depending on which offset straight guide groove 424 is used). This may be desirable in certain cases where a lip or border is required. In addition, having the straight guide grooves 424 on either side of the blade slot 412 allows the user to make the same offset cut using the left or right edge of the support surface. As with the first embodiment 100, the fourth embodiment 400 includes a button aperture 414, and a retaining rib aperture 416.

The above detailed description has set forth exemplary embodiments of the present invention in addition to what the inventor(s) have contemplated as being the preferred embodiment. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

Having thus described the preferred and exemplary embodiments, the invention is now claimed to be:

1. A cutter device capable of cutting while in sliding contact with one of a variety of sheet materials to be cut, the cutter device comprising:

a) an outer sleeve, the outer sleeve having a closed end and an open end;

b) an inner sleeve slideably engaged within the outer sleeve, the inner sleeve having a first position and a second position with respect to the outer sleeve;

c) a biasing element for biasing the inner sleeve in the second position, wherein the biasing element is disposed between the inner sleeve and the outer sleeve; and d) a blade having a sharp cutting edge extending non-parallel to a longitudinal axis of the cutter device and adapted to slideably engage and cut the sheet material, the blade being attached to the first end of the inner sleeve, wherein the blade extends beyond the outer sleeve when the inner sleeve is in the first position and wherein the blade retracts within the outer sleeve when the inner sleeve is in the second position; and e) a plurality of guide surfaces disposed on an exterior surface of the closed end of the outer sleeve and being angled inward and toward a tip of the closed end, at least one of the guide surfaces angled with respect to the longitudinal axis, wherein two or more guide surfaces are flat and intersect to form a plurality of guide edges initiating near the tip of the closed end of the outer sleeve and extending outward and rearward toward the open end of the outer sleeve.

2. The cutter device of claim 1, wherein the outer sleeve further includes a retaining rib aperture extending radially through the outer sleeve and the inner sleeve further includes a retaining rib projecting radially outward from the inner sleeve, the retaining rib engaging the retaining rib aperture of the outer sleeve.

3. The cutter device of claim 1, wherein the outer sleeve further includes a button aperture extending radially through the outer sleeve and wherein the inner sleeve further includes a button, the button being urged radially outward from the inner sleeve, the button engaging the button aperture of the outer sleeve when the inner sleeve is in the first position for holding the inner sleeve in the first position.

4. The cutter device of claim 1, wherein the closed end of the outer sleeve further includes a guide groove initiating near the tip of the closed end of the outer sleeve and extending outward and rearward toward the open end of the outer sleeve.

5. The cutter device of claim 1, wherein at least one of the guide surfaces further includes an outward projecting guide rib initiating near the tip of the closed end of the outer sleeve and extending outward and rearward toward the open end of the outer sleeve.

6. The cutter device of claim 4, wherein the guide groove is radially aligned with the longitudinal cutting edge of the blade.

7. The cutter device of claim 1, wherein at least one of the guide edges is rounded.

8. A finger-held cutter device capable of cutting while in sliding contact with one of a variety of sheet materials to be cut and capable of being guided in relation to a cutting support surface, the cutter device comprising:

a) an outer sleeve, the outer sleeve having a closed end and an open end;

b) an inner sleeve slideably engaged within the outer sleeve, the inner sleeve having a first position and a second position with respect to the outer sleeve, the inner sleeve including an open end adapted to receive and slide over a human finger for supporting the cutter device thereon;

c) a biasing element for biasing the inner sleeve in the second position, the biasing element being disposed between the inner sleeve and the outer sleeve;

d) a blade having a sharp cutting edge extending non-parallel to a longitudinal axis of the cutter device and adapted to slideably engage and cut the sheet material, the blade being attached to the first end of the inner sleeve, wherein the blade extends beyond the closed end of the outer sleeve when the inner sleeve is in the first position and wherein the blade retracts within the outer sleeve when the inner sleeve is in the second position; and e) a plurality of guide surfaces disposed on an exterior surface of the closed end of the outer sleeve and being angled inward and toward a tip of the closed end, at least one of the guide surfaces being angled with respect to the longitudinal axis, wherein two or more guide surfaces are flat and intersect to form a plurality of guide edges initiating near the tip of the closed end of the outer sleeve and extending outward and rearward toward the open end of the outer sleeve.

9. The cutter device of claim 8, wherein at least one of the guide surfaces includes at least one guide groove initiating near the tip of the closed end of the outer sleeve and extending outward and rearward toward the open end of the outer sleeve.

10. The cutter device of claim 8, wherein at least one of the guide surfaces includes an outward projecting guide rib initiating near the tip of the closed end of the outer sleeve and extending outward and rearward toward the open end of the outer sleeve.

11. The cutter device of claim 8, wherein at least one of the guide surfaces includes a first guide groove and a second guide groove, each of the first and second guide grooves initiating near the tip of the closed end of the outer sleeve and extending outward and rearward toward the open end of the outer sleeve, the first guide groove being laterally spaced apart from the second guide groove.

12. The cutter device of claim 8, wherein at least one of the guide edges is rounded.

* * * * *